US010870471B2

(12) United States Patent
Zhu et al.

(10) Patent No.: US 10,870,471 B2
(45) Date of Patent: Dec. 22, 2020

(54) SUBMARINE OPTICAL POSITIONING BEACON SYSTEM WITH SELF-GENERATING CAPABILITY

(71) Applicant: Dalian University of Technology, Dalian (CN)

(72) Inventors: Ming Zhu, Dalian (CN); Jinhao Pan, Dalian (CN); Yanhua Ma, Dalian (CN); Xin Fan, Dalian (CN); Zhenquan Qin, Dalian (CN); Zhongxuan Luo, Dalian (CN); Lei Wang, Dalian (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 34 days.

(21) Appl. No.: 16/470,934

(22) PCT Filed: Aug. 30, 2018

(86) PCT No.: PCT/CN2018/103122
§ 371 (c)(1),
(2) Date: Jun. 18, 2019

(87) PCT Pub. No.: WO2020/029346
PCT Pub. Date: Feb. 13, 2020

(65) Prior Publication Data

US 2020/0189706 A1 Jun. 18, 2020

(30) Foreign Application Priority Data

Aug. 9, 2018 (CN) ..... 2018 1 0901484

(51) Int. Cl.
*B63G 8/38* (2006.01)
*F21V 31/00* (2006.01)
*F21Y 115/15* (2016.01)

(52) U.S. Cl.
CPC ..... *B63G 8/38* (2013.01); *F21V 31/00* (2013.01); *F21Y 2115/15* (2016.08)

(58) Field of Classification Search
CPC ..... B63B 21/00; B63B 21/50; B63B 21/52; B63B 22/00; B63B 22/02; B63B 22/04;
(Continued)

(56) References Cited

U.S. PATENT DOCUMENTS 3,906,564 A 9/1975 Thompson et al.
6,850,152 B1 2/2005 Woodall et al.
(Continued)

FOREIGN PATENT DOCUMENTS

CN 201489110 U 5/2010
CN 105282695 A 1/2016
(Continued)

OTHER PUBLICATIONS

Search Report and Written Opinion dated Aug. 9, 2018, in International Application No. PCT/CN2018/103122.

*Primary Examiner* — Lars A Olson
(74) *Attorney, Agent, or Firm* — Muncy, Geissler, Olds & Lowe, P.C.

(57) ABSTRACT

A submarine optical positioning beacon system with self-generating capability, which has an array of underwater beacons. When the underwater rover moves to the vicinity of an certain underwater beacon, the underwater beacon's COMS sensor detects the underwater rover's light and then turns on the LED lamp group. The COMS sensor of the underwater rover analyzes the light species of the LED light group and converts it into digital information. The underwater rover analyzes the digital signal to obtain its location. Each underwater beacon has an independent power generation component, which generates power by utilizing ocean current, greatly increasing the working time of the beacon.
(Continued)

Figure 1A:
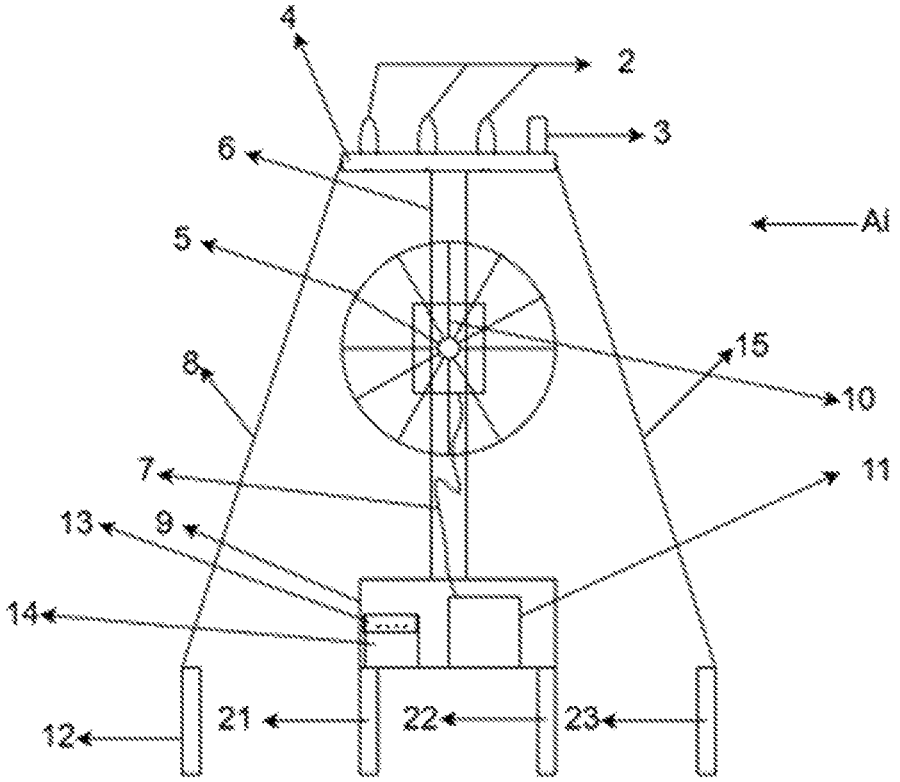

The LED lamp group gives positional information feedback through the light, which can reduce the system power consumption and increase the system working duration.

3 Claims, 2 Drawing Sheets

(58) Field of Classification Search
CPC ..... B63B 22/18; B63B 22/20; B63B 8/38; B63G 8/00; B63G 8/38; F21V 31/00
USPC ..... 114/312; 441/6, 7, 11, 13, 20, 26
See application file for complete search history.

(56) References Cited

U.S. PATENT DOCUMENTS 6,879,263 B2 * 4/2005 Pederson ..... B60Q 1/2611 340/815.45
7,046,160 B2 * 5/2006 Pederson ..... B60Q 1/2611 340/815.45

FOREIGN PATENT DOCUMENTS

CN 106287523 A 1/2017
CN 206243387 U 6/2017

* cited by examiner

SUBMARINE OPTICAL POSITIONING BEACON SYSTEM WITH SELF-GENERATING CAPABILITY

TECHNICAL FIELD

The present invention belongs to the technical field of underwater positioning, and relates to a submarine optical positioning beacon system, in particular to a submarine optical positioning beacon system with self-generating capability.

BACKGROUND

Due to the large amount of ions and other impurities in seawater, radio positioning is currently difficult to achieve in this environment. At present, the main underwater positioning methods mainly use sonar positioning and laser positioning. Sound waves are longitudinal so they are more stable underwater, but their propagation speed is relatively slow, therefore there is hysteresis in medium and long-distance positioning, which will cause that the position of the rover at that time cannot be correctly reflected. The cost of laser positioning is expensive, and the rover needs to carry energy and receivers that provide sufficient power, which greatly affects the rover performance. A few positioning systems use LED lighting for positioning, but due to the high amount of impurities on the seabed, the penetration of LED lights is weak, and it is necessary to use high-power LEDs to work properly. High-power LEDs consume a lot of power, thus systems based on the use of LED light location beacons generally do not work well for a long time.

SUMMARY OF THE INVENTION

To solve the problems in the background, the present invention provides a submarine optical positioning beacon system with self-generating capability.

The technical solution of the invention:

A submarine optical positioning beacon system with self-generating capability, consisting of an array 1, which composed of a plurality of underwater beacons $A_i$;

The underwater beacon $A_i$ is mainly composed of an LED lamp group 2, a runner 5, a generator 10 and a battery 11; the LED lamp group 2 and a COMS sensor 3 are both fixed on a waterproof casing 4, and the COMS sensor 3 is used for monitoring the light emitted by the target that needs to be positioned externally, and is used as a switch for controlling the opening and closing of the LED group 2, the COMS sensor 3 is in operation after the underwater beacon $A_i$ is turned on until the underwater beacon $A_i$ is turned off; The waterproof casing 4 is internally packaged with a circuit board, and the LED lamp group 2 and the COMS sensor 3 pin are soldered to the inner circuit board of the waterproof casing 4; the waterproof casing 4 is fixedly connected to the top end of a pillar 6, and a bearing 25 is fixed in the middle of the pillar 6; The generator 10 and the runner 5 are fixed on the bearing 25, the rotating core of the generator 10 is connected to the middle shaft of the runner 5 by soldering, and the electric power is generated by the electromagnetic induction generator 10 when the runner 5 rotates; one end of the horizontal bracket 24 is fixed on the opposite side of the bearing position of the generator 10 and the runner 5, and a deflector 16 is fixed on the other end of the horizontal bracket 24. The deflector 16, the horizontal bracket 24, the generator 10 and the runner 5 are located on the same horizontal line, and the deflector 16 is forced to drive the horizontal bracket 24, generator 10 and runner 5 rotate together, thereby ensuring that the runner 5 is always facing the ocean current; the pillar 6 is fixed on the base 9, and the base 9 is internally group with a microprocessor 14 and a battery 11; the microprocessor 14 generates a PWM wave through the control module to adjust the light species of the LED lamp group 2 to generate different color lights; the generator 10 and the battery 11 are connected by a cable 7, and the electric energy generated by the generator 10 is stored in the battery 11 through the cable 7; The surface of the base 9 of the underwater beacon $A_i$ has an ISP interface 13 for downloading the program in the control module; the bottom bracket b21 and the bottom bracket c22 are fixed at the bottom of the base 9, so that the underwater beacon $A_i$ can be smoothly fixed at the sea bottom 18; The upper ends of the chain a8 and the chain b15 are fixedly connected with the waterproof casing 4, and the lower ends are respectively fixedly connected to the bottom bracket a12, the bottom bracket b21, the bottom bracket c22 and the bottom bracket d23, so that the underwater beacon $A_i$ can be uniformly and smoothly fixed at the sea bottom 18;

The pillar 6 is a hollow pillar with a cable in the middle to supply power to the LED lamp group 2 and the COMS sensor 3.

The LED lamp group 2 is a high-power LED lamp capable of propagating 1-2 m in a turbid seawater environment and 5-10 m in clear seawater.

The beneficial effects of the present invention: each underwater beacon $A_i$ in the submarine optical positioning beacon system with self-power generating capability has an independent power generation component, which can generate power by utilizing ocean current, greatly increasing the working time of the beacon. And the LED light group of the underwater beacon is not always in working state, it works when the COMS sensor detects that the required positioning target is near the beacon; and the LED light group gives positional information feedback through light, which can reduce the system power consumption and increase the system working duration.

DRAWINGS

FIG. 1*a* is a front view of a single underwater beacon $A_i$.

Figure 1B:
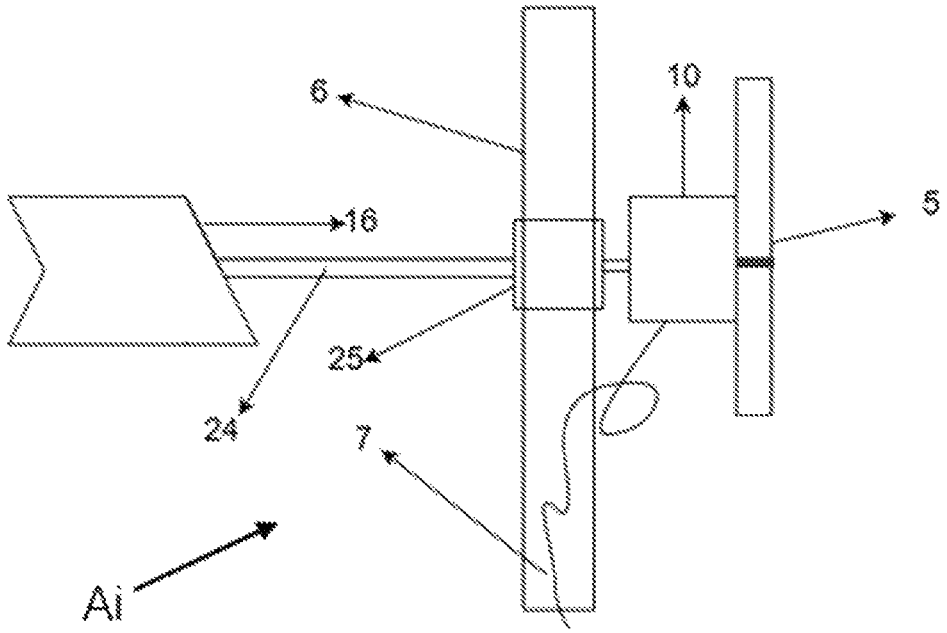

FIG. 1*b* is a side view of the middle portion of a single underwater beacon $A_i$.

Figure 2:
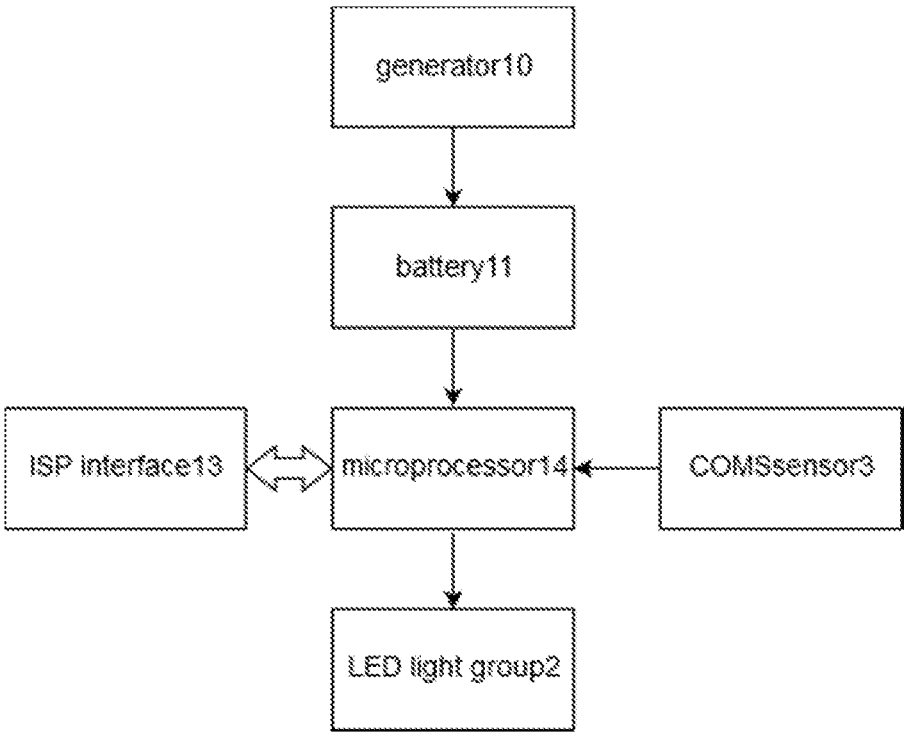

FIG. 2 is a circuit control diagram of a submarine optical positioning beacon system with self-generating capability according to the present invention.

Figure 3A:
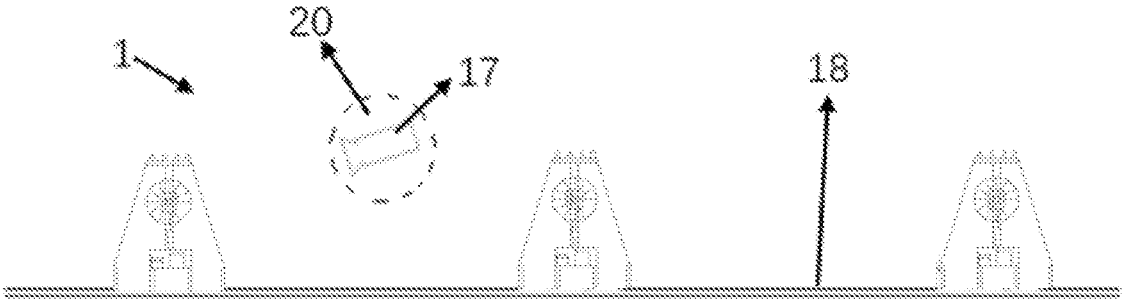

FIG. 3*a* is a schematic diagram of the movement of the rover 17 in the beacon array 1 during the implementation of the present invention.

Figure 3B:
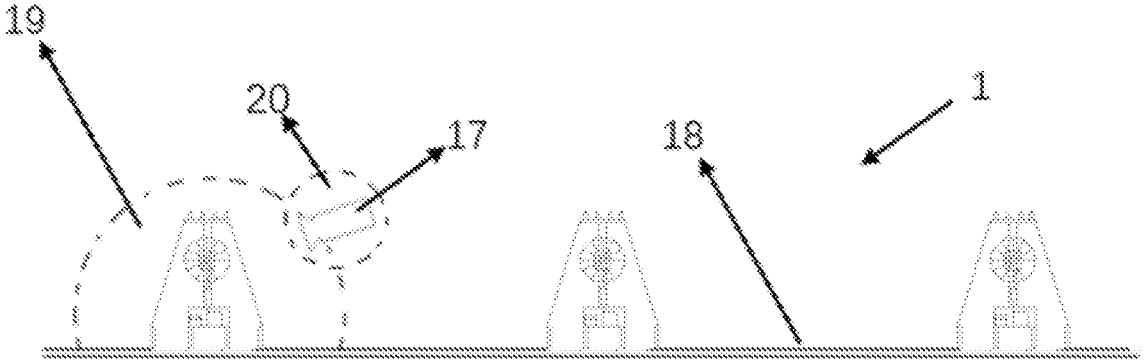

FIG. 3*b* is a schematic diagram of the rover 17 receiving location information from a certain underwater beacon $A_i$ in the specific implementation process of the present invention.

In the figures: 1 an array of a plurality of underwater beacons $A_i$; 2 LED light group; 3 COMS sensor; 4 waterproof casing; 5 runner; 6 pillar; 7 cable; 8 chain a; 9 base; 10 generator; 11 battery; 12 bottom bracket a; 13 ISP interface; 14 microprocessor; 15 chain b; 16 deflector; 17 rover; 18 sea bottom; 19 underwater beacon LED lighting area; 20 rover LED lighting area; 21 Bottom bracket b; 22 bottom bracket c; 23 bottom bracket d; 24 horizontal bracket; 25 bearing.

DETAILED DESCRIPTION

The specific embodiments of the present invention are further described below in combination with the technical solutions and the accompanying drawings.

A circuit connection of a submarine optical positioning beacon system with self-generating capability is shown in FIG. 2. The ISP interface 13, the COMS sensor 3, the LED lamp group 2 and the microprocessor 14 are directly connected, and the generator 10 and the battery 11 are directly connected. The electric energy generated by the generator 10 is stored in the battery 11, and then distributed to the COMS sensor 3 and the LED lamp group 2 by the microprocessor 14.

The working steps of a submarine optical positioning beacon system with self-generating capability are as follows:

First, the water quality assessment is performed on the active sea area where the target rover is to be located, and the optimal distance between the set beacons is determined accordingly. The program is downloaded by the ISP interface 13 of the underwater beacon $A_i$, and the microprocessor 14 executes the program command to adjust and generate different PWM waves. Under the action of the PWM wave, the LED lamp group 2 can emit a specific color light, and the LED lamp groups 2 of different underwater beacons $A_i$ emit a specific color light or a specific plurality of color lights that carry positional information corresponding to the underwater beacon $A_i$.

As shown in FIG. 3*a*, when the program download is completed, three underwater beacons $A_i$ are fixed at the sea bottom 18, forming an array 1 of a plurality of underwater beacons $A_i$. The underwater rover 17 with its own illuminating device and optical sensor moves within the array, and the underwater rover 17 always turns on the illuminating device during the movement. If the COMS sensor 3 of the underwater beacon $A_i$ does not detect the light of the underwater rover 17 (i.e. the underwater rover 17 is not in the vicinity of the underwater beacon $A_i$), the LED lamp group 2 of the underwater beacon $A_i$ does not emit light.

As shown in FIG. 3*b*, when the underwater rover 17 moves to the vicinity of a certain underwater beacon $A_i$, the COMS sensor 3 of the underwater beacon $A_i$ detects the light of the underwater rover 17 and then sends a command to the microprocessor 14 to turn on the LED light group 2. The optical sensor of the underwater rover 17 analyzes the light species of the LED light group 2 of the underwater beacon $A_i$ and converts it into digital information, and the underwater rover 17 analyzes the digital signal to obtain its position.

When the underwater rover 17 is away from a certain underwater beacon $A_i$, the COMS sensor 3 of the underwater beacon $A_i$ turns off the LED light group 2 of the underwater beacon $A_i$ because the LED light of the underwater rover 17 is not detected;

When the submarine current does not flow from the front surface of the runner 5, the deflector 16 will must be subjected to the thrust of the ocean current to drive the horizontal bracket 24, the generator 10 and the runner 5 to rotate together until the deflector 16 faces the ocean current again, reaching the balance of force and stopping rotating. At this time, the runner 5 will also faces the ocean current, and will rotate under the action of the ocean current. The runner 5 and the rotating core of the generator 10 are directly connected. When the runner 5 rotates, the rotating core of the generator 10 also rotates. The electric energy generated by the rotating core cutting the magnetic induction line is stored in the battery 11 through the cable 7.

The invention claimed is:

1. A submarine optical positioning beacon system with self-generating capability, wherein the submarine optical positioning beacon system with self-generating capability is composed of an array which is composed of a plurality of underwater beacons $A_i$;

the underwater beacon $A_i$ is mainly composed of a light-emitting diode (LED) lamp group, a runner, a generator and a battery; the light-emitting diode (LED) lamp group and a complimentary oxide-metal semiconductor (COMS) sensor are both fixed on a waterproof casing, the complimentary oxide-metal semiconductor (COMS) sensor is used to monitor the light emitted by a target that needs to be positioned externally, and is used as a switch for controlling the opening and closing of the light-emitting diode (LED) lamp group, the complimentary oxide-metal semiconductor (COMS) sensor is in operation after the underwater beacon $A_i$ is turned on until the underwater beacon $A_i$ is turned off; the waterproof casing is internally packaged with a circuit board, the light-emitting diode (LED) lamp group and a complimentary oxide-metal semiconductor (COMS) sensor pin is soldered to an inner circuit board of the waterproof casing; the waterproof casing is fixedly connected to the top end of a pillar, and a bearing is fixed in the middle of the pillar; a generator and a runner are fixed on the bearing, a rotating core of the generator is connected to a middle shaft of the runner by soldering, and an electric power is generated by an electromagnetic induction generator when the runner rotates; one end of a horizontal bracket is fixed on the opposite side of the bearing position of the generator and the runner, and a deflector is fixed on the other end of the horizontal bracket; the deflector, the horizontal bracket, the generator and the runner are located on a same horizontal line, and the deflector is forced to drive the horizontal bracket, the generator and the runner rotate together to ensure that the runner always faces an ocean current; the pillar is fixed on a base, and the base is internally set with a microprocessor and a battery; the microprocessor generates a pulse-width modulation (PWM) wave through a control module to adjust a light species of the light-emitting diode (LED) lamp group to generate different color lights; a cable is connected between the generator and the battery, and the electric energy generated by the generator is stored in the battery through the cable; the surface of the base of the underwater beacon $A_i$ has an in system programming (ISP) interface for downloading a program in the control module; a bottom bracket b and a bottom bracket c are fixed at the bottom of the base to make the underwater beacon $A_i$ smoothly fixed at a sea bottom; an upper ends of a chain a, a chain b are fixedly connected to the waterproof casing and a lower ends are respectively fixedly connected to bottom bracket a, bottom bracket b, bottom bracket c and bottom bracket d to make the underwater beacons $A_i$ uniformly and smoothly fixed at the sea bottom.

2. The submarine optical positioning beacon system with self-generating capability according to claim 1, wherein the pillar is a hollow pillar with a cable in the middle; the light-emitting diode (LED) light group and the complimentary oxide-metal semiconductor (COMS) sensor are powered by the cable.

3. The submarine optical positioning beacon system with self-generating capability according to claim 1, wherein the light-emitting diode (LED) lamp group is a light-emitting diode (LED) lamp capable of propagating 1-2 m in a turbid seawater environment and 5-10 m in clear seawater.

* * * * *